United States Patent [19]

Kehlhofer

[11] 4,207,842

[45] Jun. 17, 1980

[54] MIXED-FLOW FEEDWATER HEATER HAVING A REGULATING DEVICE

[75] Inventor: Rolf Kehlhofer, Dielstorf, Switzerland

[73] Assignee: BBC Brown, Boveri & Co., Baden, Switzerland

[21] Appl. No.: 906,828

[22] Filed: May 17, 1978

[30] Foreign Application Priority Data

Jun. 16, 1977 [CH] Switzerland ..... 7397/77

[51] Int. Cl.[2] ..... F22B 29/12

[52] U.S. Cl. ..... 122/406 S; 60/39.18 B; 122/441; 122/451 R

[58] Field of Search ..... 122/7 R, 406 R, 406 S, 122/406 ST, 441, 442, 451; 60/39.18 B

[56] References Cited

U.S. PATENT DOCUMENTS 3,769,795 11/1973 Rostrom ..... 122/7

3,955,358 5/1976 Martz et al. ..... 60/39.18

3,965,675 6/1976 Martz et al. ..... 122/406

*Primary Examiner*—Edward G. Favors

*Attorney, Agent, or Firm*—Burns, Doane, Swecker & Mathis

[57] ABSTRACT

A mixed-flow feedwater heater having a regulating device is disclosed including a feedwater tank having a deaerating dome. Steam is conveyed from a low pressure steam drum to a feedwater tank to heat and deaerate the feedwater. Feedwater is supplied from the feedwater tank either to the low pressure steam drum or to an evaporator. The water level in the low pressure steam drum is regulated to a desired level. The feedwater tank is connected to the steam drum by a steam pipe having a pressure-regulating valve which is subjected to the pressure in the mixed flow feedwater tank. The valve controls the pressure in the feedwater tank so that the pressure does not exceed a pre-determined value.

11 Claims, 3 Drawing Figures

Fig. 2
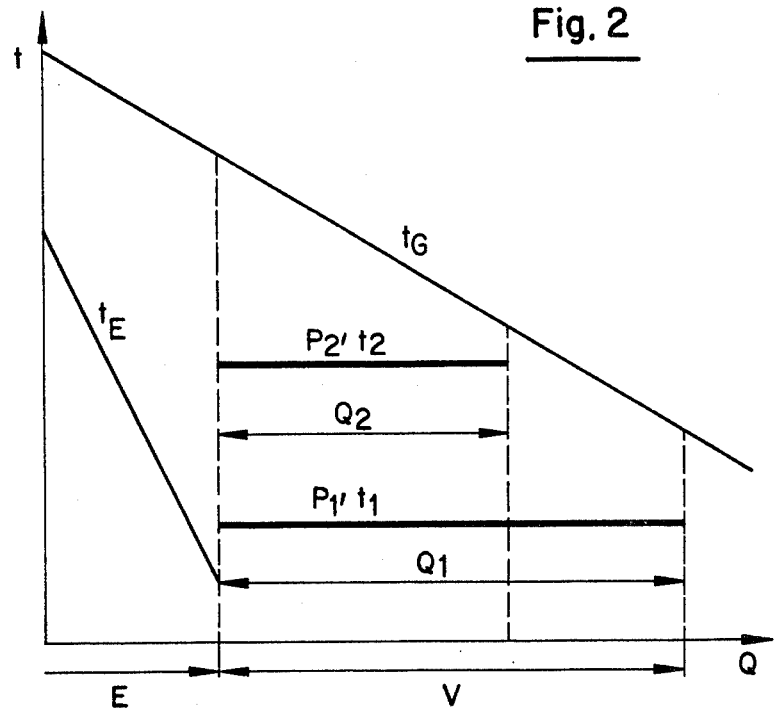
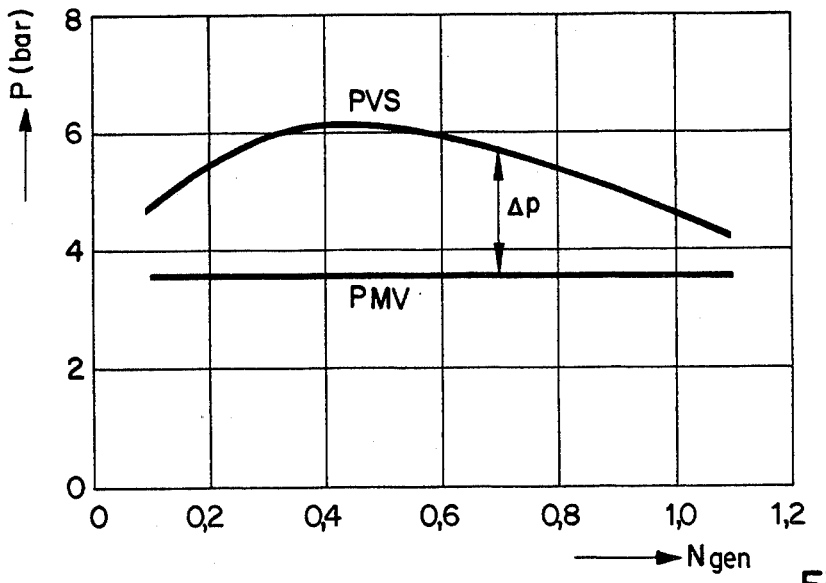
Fig. 3

MIXED-FLOW FEEDWATER HEATER HAVING A REGULATING DEVICE

BACKGROUND AND SUMMARY OF THE PRESENT INVENTION

The present invention relates generally to a mixed-flow feedwater heater having a regulating device and more specifically relates to a mixed-flow feedwater heater for a combined gas/steam turbine power plant wherein exhaust gases of a gas turbine are utilized to generate steam for a steam turbine.

In conventional waste heat boilers, it is desirable to maintain a low feedwater temperature at an inlet to the waste heat boiler for the purpose of obtaining the highest possible thermodynamic efficiency. Because of a risk of low-temperature corrosion at the end of the evaporator, however, the temperature is subject to a lower limit. In order to ensure the prevention of a corrosive attack, therefore, the feedwater inlet temperature should be maintained at a level in a range corresponding to a constant, part-load of the boiler. Depending on the specific composition of the gas turbine fuel, the temperature lies approximately between 100° C. and 150° C., and in some instances lower.

The feedwater can be heated in a mixed-flow feedheater either with steam which is bled from the steam turbine or with the heat of steam from a low pressure waste heat boiler located in the exhaust-gas flow after a high pressure waste heat boiler. An evaporator coil of the low pressure waste heat boiler is hereafter termed the feedheater loop.

In the case of feedheating with bleed steam, the steam temperature must be high enough to provide a sufficient range of control during a partial-load operation. This requirement, however, impairs the thermodynamic efficiency.

When feedheating with a feedheater loop, the impairment of efficiency is avoided since exhaust heat which would otherwise be lost is utilized. There then arises, however, the problem of regulating the feedwater inlet temperature to a value which is most favorable for the particular gas/steam turbine power plant operation.

In a known configuration of the combined gas/steam turbine power plant, the regulation of the feedwater inlet temperature is effected by discharging a supply of surplus steam from the mixed-flow feedheater into the condenser of the steam turbine. In this instance, the controlled variable is the steam pressure. The constructional expenditure for such a regulation arrangement, however, is considerable and requires, among other things, various stop valves, pipes and a condenser inlet.

An object of the present invention is to provide a regulating device requiring relatively little constructional expenditure and having a substantially flawless regulation of the feedwater inlet temperature.

The mixed-flow feedwater heater having the regulating device of the present invention includes a feedwater tank having a deaerating dome. Pipes and pumps are included for conveying steam from a low pressure steam drum into the feedheater in order to heat and deaerate the feedwater. The pipes and pumps permit the feedwater from the mixed-flow feedheater to be conveyed into the low pressure steam drum or permit the feedwater to be conveyed through the low pressure evaporator. The water level in the low pressure steam drum is regulated to a desired level. The feedwater tank is connected to the low pressure steam drum by a steam pipe having a pressure-regulating valve subjected to the pressure in the feedwater tank. The valve limits the pressure, and hence the saturated steam temperature, in the mixed-flow feedwater heater to a specified, predetermined, adjustable value.

In another form of the invention feedwater pumps are provided for both the low pressure steam drum and for the high pressure steam generator.

Still another form of the present invention has only a high pressure feedwater pump which also supplies the low pressure steam drum with feedwater by way of a branch pipe.

BRIEF DESCRIPTION OF THE PRESENT INVENTION

The present invention will now be described with reference to the accompanying drawings, wherein like members bear like reference numerals and wherein:

FIG. 2 is an illustration of the pressure and temperature conditions in the feedheater loop and in the exhaust gas flow; and FIG. 3 is an illustration of characteristics of the feedheater loop and the mixed-flow feedwater heater as a function of generator output.

DETAILED DESCRIPTION OF THE PRESENT INVENTION

Figure 1:
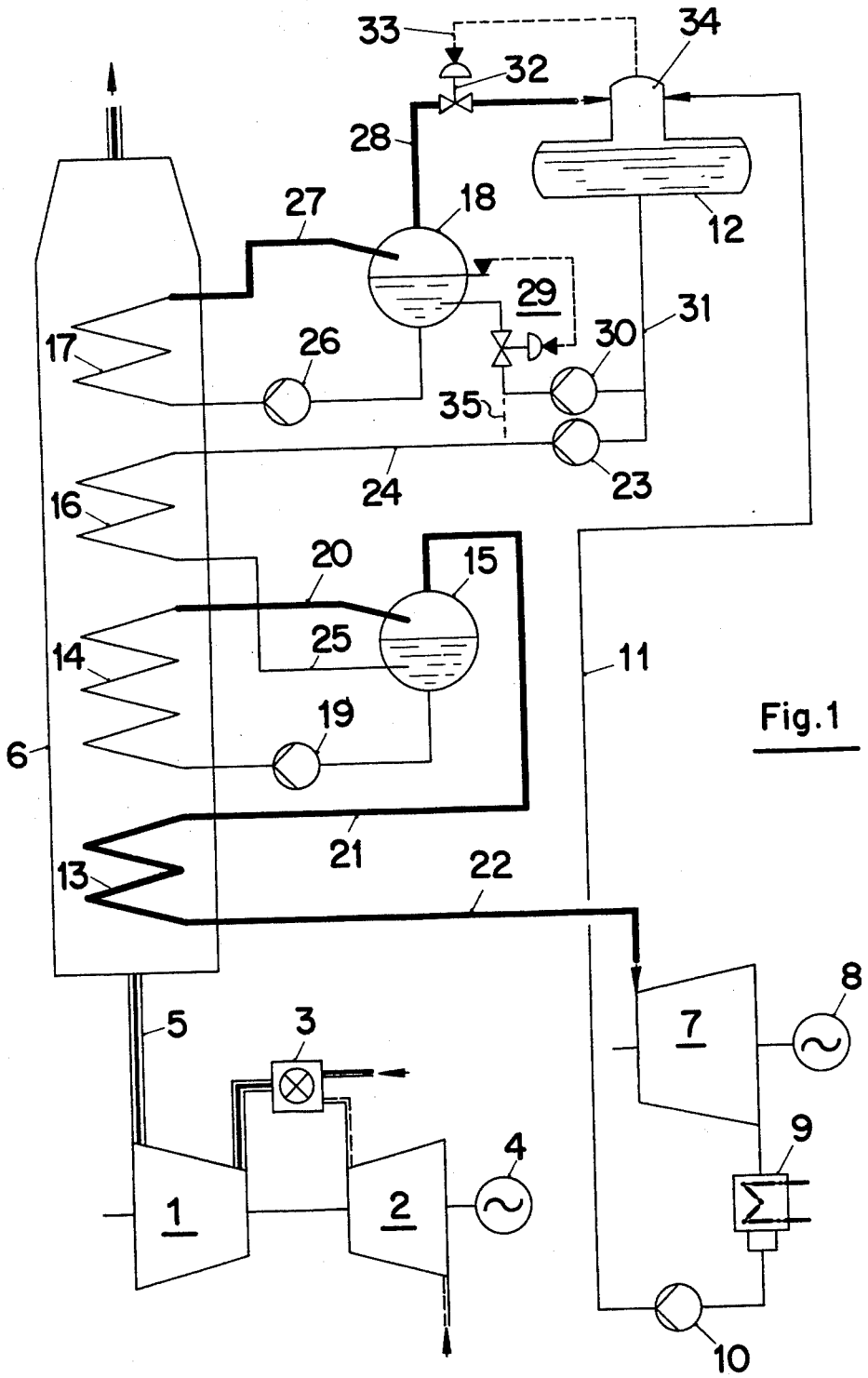
FIG. 1 is a schematic illustration of a combined gas/-steam turbine power plant having a regulating device according to the present invention.

With reference to FIG. 1, a gas/steam turbine power plant includes a gas turboset having a gas turbine 1, a compressor 2, a combustor 3 and a generator 4. Exhause gases from the gas turbine 1 pass through an exhaust pipe 5 into a waste-heat stack 6. Heating surfaces of the steam installation are located in the wasteheat stack 6. the steam installation includes a steam turbine 7, a generator 8, a condenser 9 and a condensate return pump 10 which pumps a condensate fluid through pipe 11 into a mixed-flow feedwater heater 12.

The waste-heat stack 6 contains a superheater heat exchange core 13, a high-pressure evaporator heat exchange core 14 of a high-pressure boiler drum 15, an economiser heat exchange core 16 and a low pressure evaporator heat exchange core 17 of a low-pressure boiler drum 18. Also part of the high-pressure steam generator, in addition to heat exhange cores 13 and 14, are a circulating pump 19, and a plurality of steam lines 20, 21 and 22. Furthermore feedwater pump 23 and a pair of pipes 24 and 25 between a pump 23 and the economiser 16 and between the economiser 16 and the high-pressure steam drum 15, respectively are provided.

In addition to the mixed-flow feedwater heater 12, the low-pressure evaporator heat exchange core 17 and the low pressure boiler drum 18 already mentioned, the feedheating system also includes a circulating pump 26 for the evaporator heat exchange core 17. Steam lines 27 and 28 and a level-control device 29 of a known construction for regulating a liquid level in the low pressure boiler drum 18 are provided.

A feedwater pump 30 supplies the boiler drum 18 with a pipe 32 supplying feedwater to the pumps 23 and 30 and to the regulating device for maintaining a constant feedwater temperature over the entire operating range. The regulating device includes a pressure regulating valve of a known construction which is located in the steam line 28 and is linked by way of a pipe 33 with a steam dome 34 of the mixed-flow feedwater heater 12. The pressure regulating valve 32 is subjected by way of pipe 33 to the pressure resulting in the mixed-flow feedheater.

In order to maintain a constant pressure and temperature in the mixed-flow feedheater, the quantity of heat being transferred to the liquid in the feedheater loop 17 must be continously matched to the output of the steam turbine 7. Such a regulation is provided by the valve 32 with a setting of the valve being altered in the closing direction as pressure rises in the mixed-flow feedheater. In this way, the pressure, and hence the steam temperature, in the low pressure boiler drum 18 rises and, because of the smaller temperature drop relative to the exhaust gases, the rate of heat transfer in the feedheater loop is consequently reduced.

With reference now to FIG. 2, $p_1$ and $t_1$ represent the pressure and temperature, respectively, before intervention of the regulator (the closing adjustment of valve 32). $P_2$ and $t_2$ represent the corresponding values after the intervention of the regulator. As a result of the smaller temperature drop relative to an exhaust gas temperature $t_G$, after intervention of the regulator, the quantity of heat transferred in the feedheater loop from the exhaust gases to the steam decreases from $Q_1$ to $Q_2$.

With continued reference to FIG. 2, an economiser section E is shown to extend to a feedheating section V. A behavior of the temperature $T_E$, across the economiser is also illustrated.

With reference now to FIG. 3, a behavior of the feedheater loop and the mixed-flow feedwater heater as a function of the generator output is illustrated. In this diagram, $P_{VS}$ represents the pressure in the feedheater loop, and $P_{MV}$ represents the pressure in the mixed-flow feedheater. The throttling loss in the regulating valve 32 is indicated. It can be seen that the pressure in the low pressure evaporator 17 and also in the low pressure boiler drum 18 is always above the pressure in the mixed-flow feedheater 12. Accordingly, a surplus of pressure is always available for regulating the temperature in the mixed-flow feedheater tank to a constant value.

A simplification of the apparatus of the present invention omits the feedwater pump 30 and the associated piping for feeding the low pressure boiler drum 18. The low pressure drum is then supplied by the feedwater pump 23 for the high pressure boiler drum 15. A pipe 35, indicated by a broken line in FIG. 1, is accordingly provided downstream of the pump 23. The pump 23 then supplies a branch flow to the low pressure drum 18.

The device described is especially advantageous for use in power plants operated with fuels containing sulphur, i.e. plants where the feedwater temperature has to be high in order to avoid corrosion. In such arrangements, the present invention is thermodynamically superior to a control system utilizing a regulation of the bleed steam to regulate the temperature in the mixed-flow feedheater.

The present invention which is intended to be protected herein, has been described with reference to a particular embodiment which is not to be construed as limited to the particular forms disclosed, since these are intended to be illustrative and not restrictive of the scope of the present invention which is to be interpreted from the appended claims. Variations and changes may be made by those skilled in the art without departing from the spirit of the present invention.

What is claimed is;

1. A mixed-flow feedwater heater having a regulating device, espcially for a combined gas/steam turbine power plant utilizing exhaust gases of a gas turbine to generate steam for a steam turbine, comprising:
   - a feedwater tank;
   - first fluid drum means for containing a quantity of feedwater and steam;
   - means for supplying feedwater from the feedwater tank to the first fluid drum means;
   - means for supplying steam from the first fluid drum means to the feedwater tank;
   - means for vaporizing the feedwater of the first fluid drum means; and,
   - valve means for regulating the supply of steam from the first fluid drum means to the feedwater tank; whereby a pressure in the feedwater tank is maintained at a predetermined rate.

2. A feedwater heater of claim 1, wherein:
   the feedwater tank includes a deaerating dome.

3. The feedwater heater of claim 1, wherein:
   the first fluid drum means includes a drum having means for regulating a level of water within the drum.

4. The feedwater heater of claim 3, wherein:
   the means for supplying feedwater from the feedwater tank to the drum includes a pump.

5. The feedwater heater of claim 3, wherein:
   the means for vaporizing the feedwater of the drum includes a pump.

6. The feedwater heater of claim 1, wherein:
   the means for supplying steam from the first fluid drum means to the feedwater tank includes a steam pipe.

7. The feedwater heater of claim 6, wherein:
   the valve means for regulating the supply of steam from the first fluid drum means to the feedwater tank includes a pressure-regulating valve in the steam pipe.

8. The feedwater heater of claim 7, wherein:
   the pressure-regulating valve is controlled by the pressure in the feedwater tank.

9. The feedwater heater of claim 4, wherein:
   the pump supplies feedwater only to the drum.

10. The feedwater heater of claim 1, wherein:
    the first fluid drum means includes steam at a relatively low pressure; and, further comprising:
    - a second fluid drum means for containing a quality of feedwater and steam, the steam of the second fluid drum means being at a relatively high pressure and being supplied to a steam turbine.

11. The feedwater heater of claim 10, further comprising:
    - pump means for supplying feedwater both to the first fluid drum means and to the second fluid drum means.

* * * * *